US010306963B2

(12) United States Patent
Van Geer

(10) Patent No.: US 10,306,963 B2
(45) Date of Patent: Jun. 4, 2019

(54) CREDIT CARD HOLDER WITH IMPROVED CARD EJECTOR / DISPENSER

(71) Applicant: Rene Johan Van Geer, Rijswijk (NL)

(72) Inventor: Rene Johan Van Geer, Rijswijk (NL)

(73) Assignee: R.J. VAN GEER BEHEER BV, Rijswijk (NL)

( * ) Notice: Subject to any disclaimer, the term of this patent is extended or adjusted under 35 U.S.C. 154(b) by 204 days.

(21) Appl. No.: 14/653,068

(22) PCT Filed: Dec. 17, 2013

(86) PCT No.: PCT/NL2013/050909
§ 371 (c)(1),
(2) Date: Jun. 17, 2015

(87) PCT Pub. No.: WO2014/098580
PCT Pub. Date: Jun. 26, 2014

(65) Prior Publication Data

US 2015/0335118 A1 Nov. 26, 2015

(30) Foreign Application Priority Data

Dec. 17, 2012 (NL) ..... 2009993
Dec. 16, 2013 (NL) ..... 2011970

(51) Int. Cl.
*B65D 83/08* (2006.01)
*A45C 11/18* (2006.01)

(52) U.S. Cl.
CPC ..... *A45C 11/182* (2013.01); *B65D 83/08* (2013.01)

(58) Field of Classification Search
CPC . A45C 11/82; A45C 11/182; A45C 2001/083; A45C 1/06; A45C 11/328; B65D 83/08
(Continued)

(56) References Cited

U.S. PATENT DOCUMENTS 4,817,253 A * 4/1989 Harmatuik ..... A45C 11/182 150/137
4,887,739 A 12/1989 Parker
(Continued)

FOREIGN PATENT DOCUMENTS

CH 702919 B1 10/2011
EP 0 287 532 A2 10/1988
(Continued)

OTHER PUBLICATIONS

International Search Report, dated May 12, 2014, from corresponding PCT application.
(Continued)

*Primary Examiner* — Sue A Weaver
(74) *Attorney, Agent, or Firm* — Young & Thompson

(57) ABSTRACT

A holder for cards, including a housing (1) which tightly fits around a stack of at least three cards (2) and has at least one card opening (3) for locating and removing cards, while opposite the card opening (3) within the housing a card eject feature is provided such that the cards through the card opening (3) can be partly slid from the housing, which card eject feature is designed to move within the housing between a first and a second position and during the movement forces the cards to partly exit the housing. The holder has a feature to avoid jamming of the card eject feature while engaging the cards stack and forcing them to exit the housing, preferably allows the jamming element to deflect, e.g. since the jamming element keeps a sufficient gap.

27 Claims, 4 Drawing Sheets

(58) Field of Classification Search
USPC ..... 206/37.4, 39.4; 150/147, 149, 137
See application file for complete search history.

(56) References Cited

U.S. PATENT DOCUMENTS

| | | | |
|---|---|---|---|
| 5,718,329 | A | 2/1998 | Ippolito et al. |
| 2002/0074246 | A1 | 6/2002 | Tiscione et al. |
| 2005/0224149 | A1 | 10/2005 | Tiscione |

FOREIGN PATENT DOCUMENTS

| | | | |
|---|---|---|---|
| JP | 60-179484 | U | 11/1985 |
| WO | 2010/137975 | A2 | 12/2010 |

OTHER PUBLICATIONS

Netherlands Report on the Investigation to the Prior Art issued in Application No. 2011970, dated on Apr. 9, 2015 with Computer Generated English Translation.

* cited by examiner

CREDIT CARD HOLDER WITH IMPROVED CARD EJECTOR / DISPENSER

BACKGROUND OF THE INVENTION

Field of the Invention

The invention relates to a card holder provided with a device (further also called "ejector") to eject or dispense the cards, or different flat or plate like objects, from the holder and wherein the card or cards tightly fit within the holder, for which the holder has a cavity similar to the shape and slightly bigger than the card or cards stack.

Description of the Related Art

The prior art discloses such holders for cards, designed to address the problem of easily selecting the desired card from a stack placed in the holder. Document EP-A 0 287 532 discloses a holder shaped as a flat box or sleeve, in which the stack of cards tightly fits. This housing has inside a pivoting ejector arm which by means of a finger button projecting through a curved elongate opening in the holder wall can be pivoted, with the effect that the stack of cards slides outwards. Since the ejector arm is provided with a relief profile such that each card engages with a different edge at the ejector arm, the cards are dispensed as a staggered stack. CH702919 B1 discloses a similar card holder. WO2010137975 (of the present inventor Van Geer) also discloses a card holder with an implement to present a staggered stack of cards, partly projecting out the card holder. U.S. Pat. No. 5,718,329 discloses an at both ends open sleeve like card holder. A card ejector is lacking.

All these prior art holders are prone to jamming of the ejector arm during daily use.

BRIEF SUMMARY OF THE INVENTION

The object of the invention is versatile. In one aspect the object is a card holder which is less prone to jamming of the ejector arm. In another aspect the object is to offer a comfortable, simple and accurate operation of the holder with long life. Other aspects can be learned from the specification, drawings or claims. Two or more aspects can be combined.

Preferably the invention is directed to a card holder dispensing the complete stack of cards in such a manner that a staggered stack of cards, partly projecting out the card holder, is presented. In the alternative the ejector device is designed to provide that the stack of cards is partly projected from the card holder, wherein de cards are presented in a staggered fashion, while when completely contained within the housing, the cards are in register (in other words the cards are not staggered). By presenting the cards in staggered fashion, they can be easily individually identified and individually taken from the stack by two fingers of the hand of the user. The card holder is preferably rigid in relation to the typical loads to which the card holder is exposed during normal daily use.

According to the invention this object is obtained by allowing the ejector arm to deflect, preferably in the direction towards and away from the opposite main sides of the holder. Preferably the design of the cardholder is such that the ejector arm can deflect at least 0.2 millimeter, preferably at least 0.35 millimeter, most preferably at least 0.5 millimeter, such value being on top of the typical fabrication tolerances of the assembled card holder. In other words, such dimension should be present if the ejector arm in its operative position is stably supported by the relevant surface of the associated holder main side. In a preferred embodiment such deflection is allowed by providing a gap, preferably of sufficient said dimension (at least 0.1 or 0.35 or 0.5 millimeter), between the relevant part of the ejector arm and the associated main side of the holder, such that the ejector arm can move in and out said gap while deflecting.

To allow such deflection, one could provide the holder body with a convenient feature, e.g. a recess into the inner face of the relevant main side, to allow the ejector arm to enter and exit said recess when deflecting. However it is preferred to provide the holder body with smooth, level and flat inner faces of the main sides, e.g. with a view to ease of production through e.g. extrusion and/or avoidance of damaging the inserted cards. Thus it is preferred to provide the ejector arm with a convenient feature to allow deflection.

Preferably the ejector arm is designed to deflect at an intermediate area along its length, such that on both longitudinal sides of this area such deflection is absent. In an embodiment such is obtained by providing that said gap is present at said intermediate area while said gap is absent at both longitudinal sides of this area. In practice such could be obtained by providing this intermediate area with a recess facing the associated holder main side, such recess providing the desired gap. Advantageously such recess is provided such that if the ejector arm in its operative, unloaded position is supported by the flat surface of the holder main side, said intermediate area keeps said gap with said holder main side surface while at both longitudinal sides of the intermediate area the ejector arm bears with a support area onto the holder main side surface. Consequently, if the ejector arm is loaded to deflect towards the main side, the intermediate area will enter the gap and makes it smaller. Obviously, such support area is designed to slide across the associated surface of the holder main side.

Preferably the intermediate area at least partly or completely overlaps with at least part of the ejector arm area bearing the features, e.g. relief profile, for ejecting the cards stack in staggered fashion. In an embodiment said intermediate area partly overlaps with said relief profile bearing area and also extends some distance beyond said relief profile bearing area, preferably towards the location where the ejector arm is mounted to the holder body, e.g. for a distance of at least 5 millimeter, preferably at least 9 millimeter, more preferably at least 12 millimeter.

In a development the ejector arm at its side opposite its side bearing the intermediate area has a bearing face intermediate the free tip and the mounting location of the ejector arm, which bearing face slidingly engages the main side. Said bearing face preferably is located at a longitudinal distance from the free tip corresponding to a distance approximately midway the length of the intermediate area, e.g. somewhere between one third and two third the length of the intermediate area.

In an embodiment the ejector arm has two longitudinally spaced first bearing surfaces at its side facing the one holder body main side and a single second bearing surface at its opposite side (facing the other holder body main side). The first bearing surfaces preferably have the intermediate area (for deflection) between them. The second bearing surface preferably is located between the first bearing surfaces, more preferably approximately midway, e.g. somewhere between one third and two third the longitudinal distance, between the first bearing surfaces. The first and second bearing surfaces will slide across the associated holder body main side and in this manner the ejector arm is stably guided by the holder body.

In a preferred development such deflection is facilitated by adding flexibility to the ejector arm, preferably in the direction towards and away from the opposite main sides of the holder. Preferably this flexibility is obtained by a small wall thickness, preferably in the area between the location where the ejector arm is mounted to the holder body and the for engagement with the cards provided relief profile at the ejector arm. Preferably the wall thickness is small in the complete area between the relief profile and the mounting to the holder body. Practically, the flexibility is such that the free tip of the operatively mounted ejector arm will deflect at least 1 millimeter, preferably at least 3 millimeter, more preferably at least 5 millimeter towards a main side when loaded at the free tip by a force of 1 kilogram directed towards said main side and the ejector arm is fixedly clamped at its mounting point.

In particular the holder is designed to receive and dispense credit cards (and different items with dimensions comparable to credit cards, further mentioned as "cards"), preferably wherein a stack of, e.g. at least three, four or five, cards can be housed in the holder, more preferably wherein the cards in the stack are immediately mutually superposed or adjacent, in other words not further object is or needs be present between adjacent cards. The holder preferably has two pairs of substantially or completely closed and fixed opposite sides, one pair with length and width almost equal to the same card dimensions (also called the "main sides") and this pair spaced by the other (also called the "minor sides") pair (delimiting the stack thickness) such that the card stack tightly fits between these four sides. Preferably these sides are thin walled and/or provide a rigid, sleeve like casing. Of the remaining pair of two opposite sides preferably one (also called the "bottom") is permanently substantially or completely closed and the other (also called the "top") is open but could be temporary closed, e.g. by a lid, such that the holder has merely a single open side through which the cards can enter and exit the holder. Thus the holder provides a rigid sleeve with closed bottom.

Preferably the holder is provided with means to keep the cards within the holder without closing the top side with a lid, e.g. friction means which e.g. engage the thin sides of the cards, such as e.g. disclosed by WO2010137975.

The ejector comprises an ejector element (further also called "arm") moving between a first and second (preferably a retracted and an extended, respectively) position inside the holder and engaging the cards stack, preferably engaging an edge of the cards, to push the cards stack out of the holder while the cards move in a plane parallel to their main faces, preferably such that the cards (with the element in its extended position) partly project from the holder in a stepped or staggered manner. For the purpose of presenting or dispensing the cards in a stepped manner, the element is preferably provided with a relief profile, preferably having some relation with the thickness of the cards, such that the element has a plurality of spaced features, preferably located along a straight line, a such feature designed to engage a single card from the stack, preferably such that by movement of the element within de holder, the one card is moving with the element for a further distance outward compared to another card from the same stack within the holder. In an embodiment such features are projections at the element each providing an engagement edge, wherein preferably the projections project a different distance from the element such that each engagement face is present at a different level.

Preferably the element is designed such that, in its retracted position, the cards fit within the holder such that the cards are mutually in register, in other words, present a neat stack.

Preferably the thickness of the ejector arm stepwise increases from the free end (in other words the distal end or the end remote from the pivot point or the end opposite the end to which the drive means engage or are mounted). This stepwise increase of thickness provides step shaped features for ejecting the cards stack in a staggered fashion.

In its extended position, the ejector arm preferably extends diagonally within the holder. In its retracted position, the ejector arm preferably extends parallel to an external side or edge of the holder, preferably opposite the side from which the cards are dispensed from within the holder. Preferably the ejector arm rotates or swivels or turns or hinges or pivots between its first and second position, for which it is preferably provided with a hinge or pivot feature, such as a pin or hole, with which it is mounted to the holder. In the alternative a translating movement is feasible.

To provide the movement of the ejector arm, the ejector comprises a drive means associated with the ejector arm. This could be a motoric means however a manually operated drive means, e.g. a finger operated button, is preferred. Preferably the ejector arm and the drive means are connected in a rigid manner such that the movement of the drive means is directly transferred to the ejector arm and both these members move as one, e.g. since both these members are integrated in a single, preferably rigid piece. The ejector arm and/or drive means could be injection moulded parts, e.g. of polymeric or plastic or equivalent material.

Preferably the ejector arm provides a base or bottom of the holder, preventing exit of the cards from the associated side of the holder.

For the so called credit card format the main dimensions suffice ISO 7810 and the thickness and roundings suffice ISO 7813. This format is used for many cards with different applications: bank cards, driving licenses, ID-cards, membership cards, entrance cards, reduction cards, savings cards, etc.

The invention is based on the teaching that cards of credit card format indeed have a standardised thickness, but this has always some dispersion due to unavoidable fabrication tolerances. Also, cards are not always as flat as they should be, they e.g. warp in time due to use. With the holders with ejector arm presently known, jamming occurs due to such imperfect cards. Also imperfect flatness of the main walls of the holder can cause jamming. Jamming can either require increased manual force to operate the ejector device, or can cause immovability of the ejector device. Typically the jamming location corresponds to an individual feature, e.g. step, of the means for ejecting the cards in a staggered fashion and depends on the number and type of cards stacked between such feature and the corresponding main side. Thus, for the same holder, the jamming location can the one time be at the one and another time at the other of the plurality of steps, such that the ability to deflect according to the invention is preferably provided for at least most or substantially all of the steps.

The card ejector feature gives the user the opportunity to partly slide the card stack from the housing. This is a preferred operation before the user can select a card and remove it from the housing.

An embodiment of a card ejector as part of a card holder of the invention, is made from a recess in the housing which offers sufficient space to push with a finger the card stack partly out of the housing through the card opening.

If this recess extends continuously across three faces, first the front, second the back opposite the card opening and third the back opposite the front, while the recess in the front is less deep compared to the recess in the back, the finger with which the stack is pushed from the housing, ends this push movement in an inclined position relative to the front and back, whereby the card stack is step like slid out of the housing.

If the card in a stepped stack is slid from the housing, each card shows a narrow edge and the user can see at a blink which cards are present in the holder. Also the user can easy and quick select within the cards stack the desired card and remove it by manually sliding the cards mutually in a direction equal to or opposite the direction in which the cards are slid from the housing from their stored position An embodiment of the card ejector feature of the invention comprises, among others, a step like element, which by the user relative to the housing, e.g. by means of rotation or translation, can be moved against the cards stack, wherein the individual steps of the sep like element exert at the individual cards in the stack in the direction of the card opening a force, resulting that the card stack slides outward in stepped shape. The steps have a thickness which is measured parallel to the card thickness and a spacing which is measured perpendicular to the thickness and which determines the degree wherein the cards slide mutually if they slide in stepped shape from the housing.

An embodiment of the step like element has steps with a thickness or level difference equal to approximately the card thickness or equal to or less then half or one third the card thickness. For modular nature between 0.3 and 0.5 millimeter, e.g. approx. 0.4 mm, is a preferred thickness for the step, since this equals approx. half a typical smooth card thickness (approx. 0.8 mm) and approx. one third of the thickness of a card with embossing (approx. 1.2 mm). If the stepped element pushes against the card stack, a smooth card with thickness 0.8 mm will skip one step and an embossed card will skip two steps, thus a card stack containing a mixture of flat and smooth cards can be ejected neatly. The first and last step may be an exception to this and obtain a thickness of e.g. approx. 0.8 mm, since the first and last step in operation generally will never bear against a halve card thickness.

The step like element preferably has a number of steps at least equal to the number of cards in the stack, more preferably at least equal to one and a half time the number of cards in the stack (in the latter case. In a preferred embodiment wherein the holder is designed to contain at least four or five stacked cards, preferably the step like element has at least four or five and alternatively at least six or eight steps.

The spacing of the steps depends from the maximum number of cards that can be stored in the housing. The maximum length of the step like element is limited by the holder and the spacing between the steps is spread over this available length. The stepped element in the housing for a thin card stack can obtain a lager spacing compared to a housing for a thick card stack. The larger the spacing between the steps, the further the dispensed cards are staggered.

An embodiment of the moving step like element in the card remove feature of the card holder of the invention, is provided with a reset means, e.g. a spring, with the effect that this step like element after operation will always immediately and automatically return to the initial position, such that without obstruction the user can slide cards back into the housing during making a selection from the partly exposed cards.

Information stored electromagnetically in the cards, can be damaged by the influence of strong electromagnetic radiation fields. Also cards provided with a RFID chip can be contactless read by means of radio waves if they are near an adapted reader. These are two examples of the mostly undesired interaction that can happen between electromagnetic radiation and cards in the housing. An embodiment of the cardholder of the invention which excludes these influences has a housing made of a galvanic material. The geometry of the housing of this invention lends itself for fabrication by means of metal extrusion, with which a proper Faraday cage is made.

A possible embodiment which allows further protection from external influences, like moist and dirt, comprises a housing which can be closed with e.g. a pivoting lid or a flexible part, e.g. a rubber cap.

BRIEF DESCRIPTION OF THE DRAWINGS

The invention will now be further explained by way of the drawing.

DETAILED DESCRIPTION OF THE PREFERRED EMBODIMENTS

FIGS. 1*a*, 1*b*, 2*a*, 2*b*, 3*a*, and 3*b* show a perspective view of the housing of the card holder which tightly fits around the shown stack of at least three cards (four are shown), wherein one of the two longitudinal ends of the housing is referred to as a card opening because it is opened to receive and remove cards. The tightly fit around the card stack implicates a main shape based on a right angled brick, but it can of course, for reasons of design or ergonomics, differ, e.g. by providing chamfers, roundings, ribs, etc.

Figure 1A:
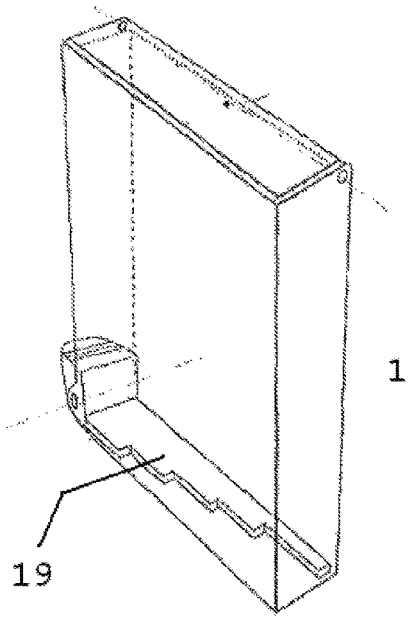
FIGS. 1*a*, 1*b*, 2*a*, 2*b*, 3*a*, and 3*b* show the operation of the ejector arm of a card holder, in perspective (FIGS. 2 and 3 also in side view)
Figure 1B:
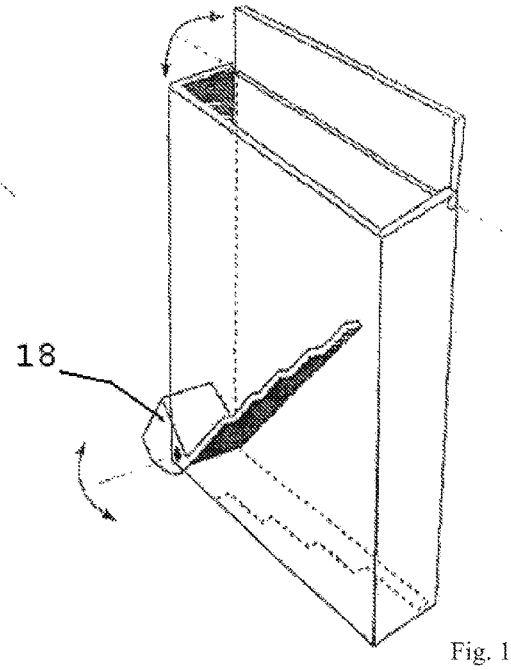

FIGS. 1*a*, 1*b* show the empty holder and the ejector arm in the first and second position, respectively. The engagement faces at different levels projecting from the ejector arm, to eject the cards stack in staggered fashion, are clearly visible. Also visible is the finger button projecting outside the holder and driving the ejector arm.

Figure 2A:
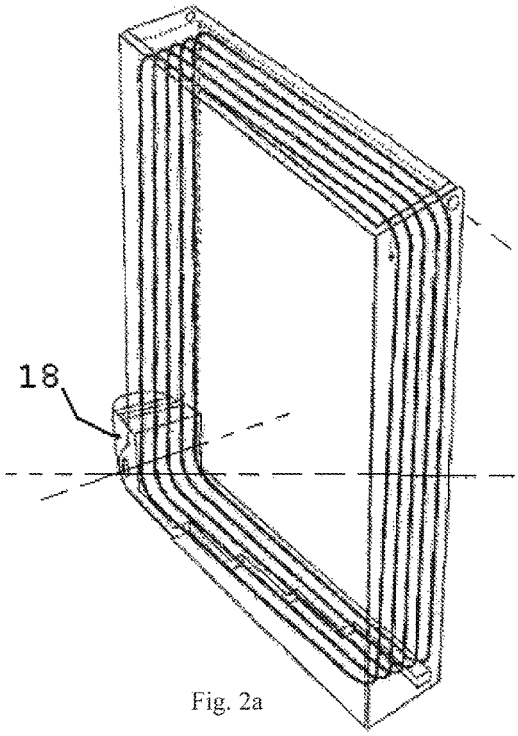
Figure 2B:
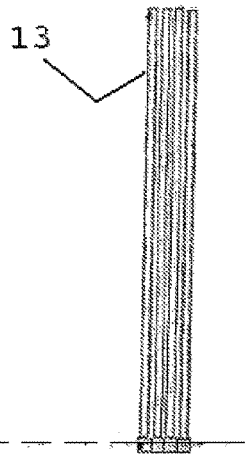
Figures 3A, 3B:
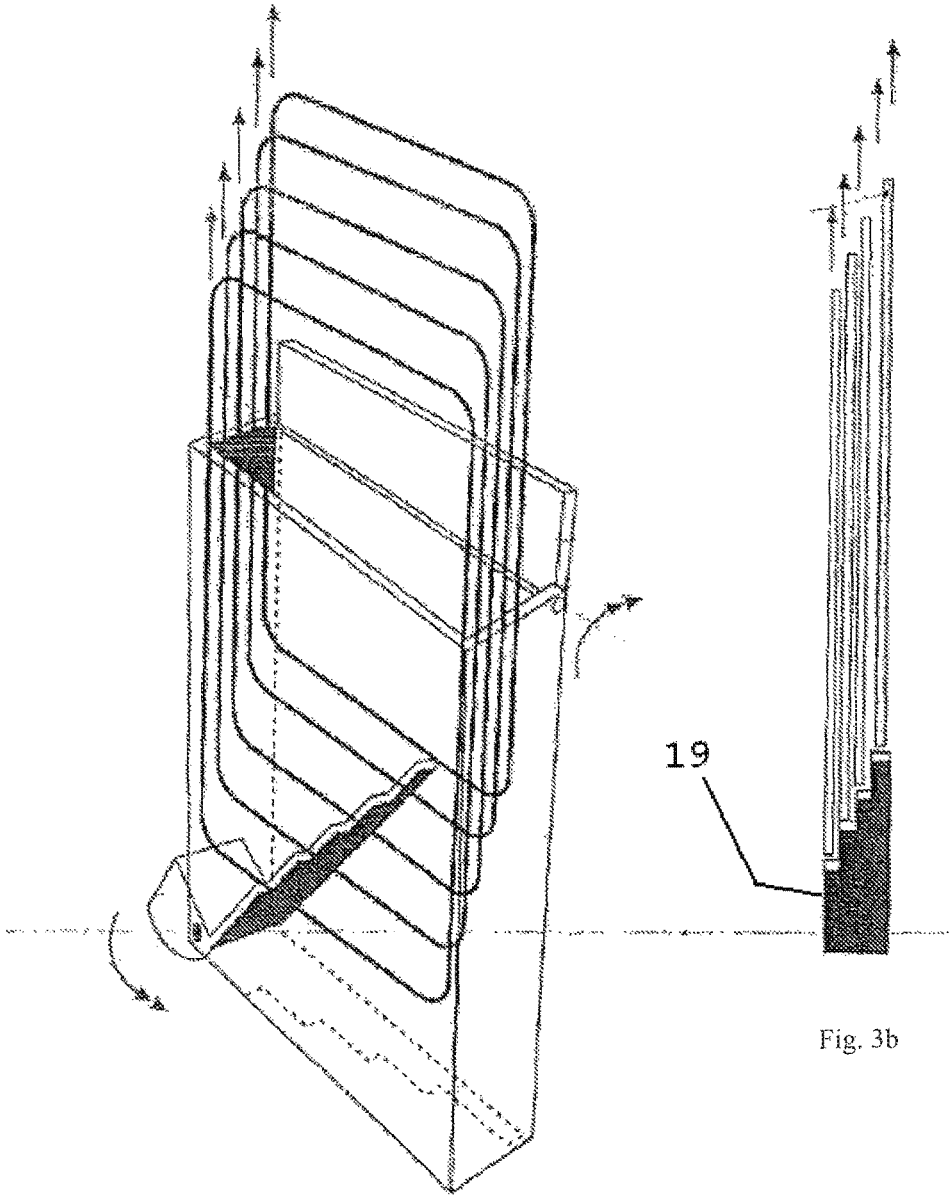

FIGS. 2*a*, 2*b* show the holder filled with four stacked cards in register, the lower side of each card in register with a relevant engagement face of the ejector arm in its first (retracted) position. Starting from this position of the ejector arm and moving (pivoting) it to its second position, the cards will be forced by the associated engagement face such that the cards stack is partly ejected. Since each engagement face has a different distance to the pivot point of the ejector arm, each card will travel a different distance such that a staggered ejected stack is obtained (shown in FIGS. 3*a*, 3*b* in which the ejector arm is in its second position).

Figure 4:
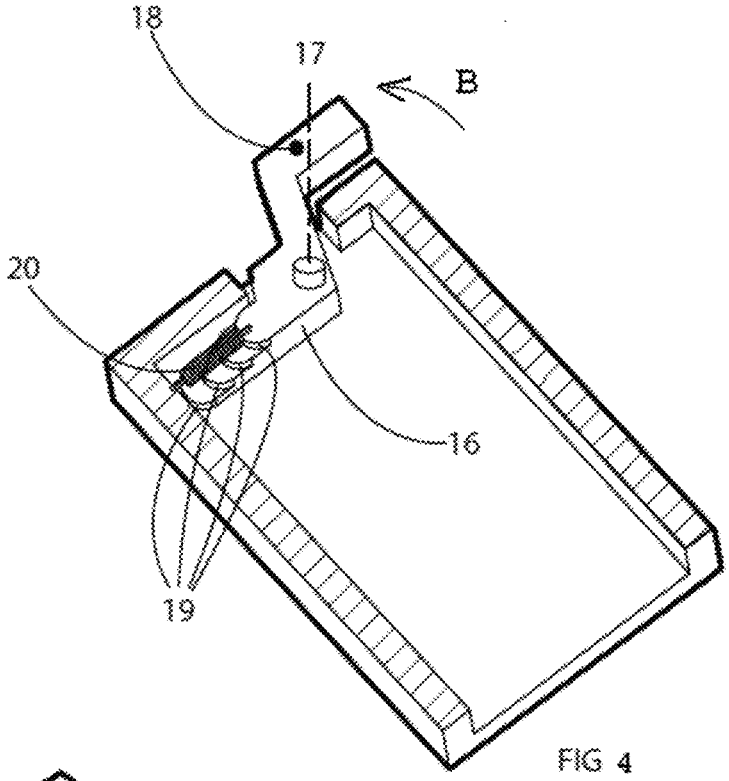
FIGS. 4 and 5 show in perspective view two movement possibilities of the ejector arm, mounted within a card holder which is shown in sectional view.

FIG. 4 shows in sectional view a holder with a card eject feature provided by an ejector arm 16 in the form of a stepped element which can pivot around an axis 17 if the user exerts in the pivot direction (according to the arrow) a force through the actuator 18 outside the housing, or immediately at the operation face 18*a* as part of the stepped element. The stepped element is made from steps, wherein the card contact face 19 can exert force against the side of the cards which faces the ejector arm 16. The card contact face 19 can be regarded as a stepped profile where the thickness of the steps in the stepped shape and the height of these faces is equal to or smaller then the nominal card thickness (approx. 0.8 mm), whereby each step contacts a different card. A reset spring 20 ensures that the stepped element after releasing the button 18 returns immediately and automatically to the initial (first) position shown.

Figure 5:
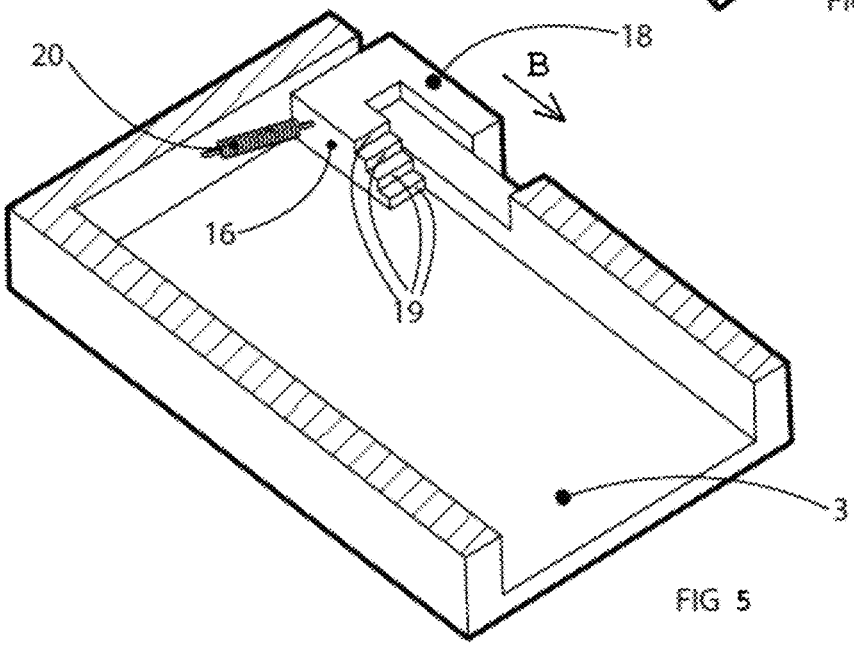

FIG. 5 shows a possible variant of the embodiment of FIG. 4, wherein the stepped element can translate in the direction in which the cards are slid through the card opening 3 and out the housing (illustrated by the arrow) and which by means of a reset spring 20 after releasing the operation part 18 returns immediately and automatically to the initial position. As will be appreciated, the cards stack is also staggered if completely inside the holder, in this embodiment.

As is clear from all FIG. 1-5, the thickness of the ejector arm stepwise decreases from the proximal (close to the pivot point 17) to the distal (free or remote) end 5.

Figure 6:
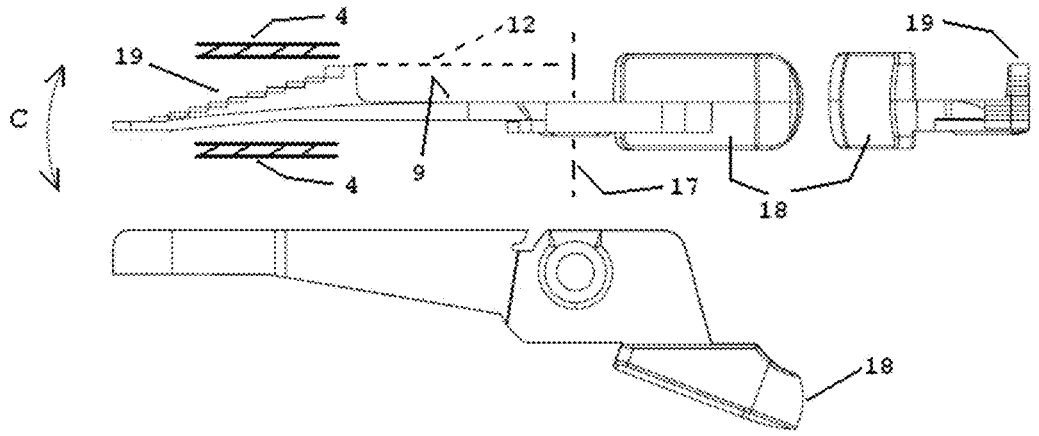
FIG. 6 shows a presently preferred embodiment of the ejector arm of the invention, in side, top and end view.
Figure 7:
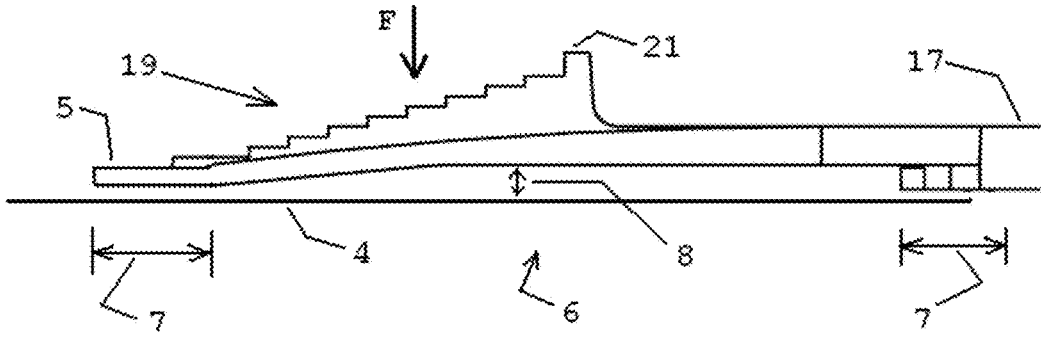
FIG. 7 shows the ejector arm of FIG. 6 more in detail.

While it is feasible to design the holder assembly such that for avoiding jamming the tip 5 should deflect relative its associated main side (in other words the nearest main side), the following design is more preferred and FIGS. 6 and 7 show a presently preferred embodiment:

The main side walls 4 have smooth, level and flat inner faces and the ejector arm is designed to deflect at an intermediate area 6 along its length, such that on both longitudinal sides 7 of this area 6 such deflection is absent. Thus this intermediate area 6 has a recess 8 facing the associated holder main side 4, such recess providing the desired gap. The gap width, according to the orientation of arrow 8, thus the distance between the bottom of the recess and the nearest side 4, is 0.4 millimeter plus typical tolerances. As shown, such recess 8 is provided such that if the ejector arm in its operative, unloaded position is supported by the flat surface 4 side, said intermediate area 6 keeps said gap 8 with said side surface 4 while at both longitudinal sides 7 of the intermediate area 6 the ejector arm bears onto the holder main side surface 4. Consequently, if the ejector arm is loaded (arrow F) to deflect towards the main side 4, the intermediate area will enter the gap such that the gap will become smaller.

As shown the intermediate area 6 overlaps the ejector arm area bearing the relief profile of the contact face 19, and also extends some distance beyond said relief profile of the contact face 19 towards the mounting location 17 where the ejector arm is mounted to the holder body.

Also, the ejector arm at its side opposite its side bearing the intermediate area 6 has a bearing face 21 intermediate the free tip 5 and the mounting location 17 of the ejector arm, which bearing face 21 slidingly engages the associated main side 4. Said bearing face 21 is located at a longitudinal distance from the free tip 5 corresponding to a distance approximately midway the length of the intermediate area 6, in other words somewhere between one third and two third the length of the intermediate area.

The force (arrow F) causing jamming of the ejector arm, typically will be located at the bearing face 21 or any of the steps of the relief profile depending on the types of cards in the stack and their deformation (embossed, warped, etc.).

Thus, the ejector arm shown in FIGS. 6 and 7 has two spaced first bearing surfaces 7 at its side facing the one holder body main side 4 and a single second bearing surface 21 at its opposite side (facing the other holder body main side 4). The first bearing surfaces 7 delimit the intermediate area 6 (for deflection) between them. The second bearing surface 21 is located, as viewed longitudinally, between the first bearing surfaces 7. The first and second bearing surfaces 7, 21 will slide across the associated holder body main side 4 and in this manner the ejector arm is stably guided by the holder body.

Further, the deflection of the area 6 to enter the gap is facilitated by adding flexibility to the ejector arm in the direction towards and away from the opposite main sides 4 of the holder. Such flexibility is obtained by a small wall thickness, in the area between the location 17 where the ejector arm is mounted to the holder body and the for engagement with the cards provided relief profile of the contact face 19 at the ejector arm. As shown, the wall thickness is small in the complete area between the relief profile 19 and the mounting 17 to the holder body.

FIG. 6 shows the ejector arm with improved flexibility of the invention. In the side view a part of the opposite main sides 4 of the holder are shown in cross section. Clearly, the ejector arm fits tightly between these sides 4, although the clearance is shown exaggerated for illustrative purposes. The dashed line 12 indicates the initial material boundary of a rigid ejector arm. By decreasing the thickness this boundary 12 changed in boundary 9, resulting in an improved flexibility according to the arrow C shown. Thus the deflection towards the nearest side 4 by the intermediate area 6 is facilitated.

As a consequence of deflection into the gap 8, the relief profile of the contact face 19, apart from the part of the relief profile of the contact face 19 within the area 7 supported by the side 4 (in this embodiment the free tip 5 belongs to this area 7) is now able to move away from the side 4 opposite the side bearing the areas 7. This deflection avoids jamming during ejecting the cards stack.

Also different embodiments belong to the invention. Features of different in here disclosed embodiments can in different manners be combined and different aspects of some features are regarded mutually exchangeable. All described or in the drawing disclosed features provide as such or in arbitrary combination the subject matter of the invention, also independent from their arrangement in the claims or their referral.

The invention claimed is:

1. A holder for cards, comprising:

a housing having a first and second opposite, mutually spaced first and second main walls which determine a maximum stack thickness, which housing is configured to tightly fit around a stack of at least three cards and has at least one card opening for locating and removing cards, wherein opposite the card opening within the housing a card eject feature having an eject arm having two opposite sides, an under side and an upper side, is provided such that the cards through the card opening can be partly slid from the housing by the eject arm, which card eject feature is configured to move, by manual actuation, the eject arm within the housing between a first and a second position, which eject arm has at its upper side, in other words its side facing the first main wall, a stepped relief profile which engages the cards stack during ejection and during said movement from the first to the second position the eject arm engages the cards and forces the cards to partly exit the housing, wherein the holder has a feature to avoid jamming of the eject arm of the card eject feature while engaging the cards stack and forcing them to exit the housing, which feature comprises a gap that is present between the second main wall and the facing under side of the eject arm, allowing the eject arm to deflect into said gap and towards the second main wall to avoid jamming of the eject arm.

2. Holder according to claim 1, wherein the eject arm is designed to deflect at an intermediate area along its length, such that on both longitudinal ends of this area such deflection is absent, since it is provided that the gap is present at said intermediate area while said gap is absent at both longitudinal ends of this area and these longitudinal ends are slidingly engaged with the second main wall of the housing to slide across it during movement of the eject arm from the first to the second position, wherein the eject arm has two longitudinally spaced first bearing surfaces at its side facing the second main wall of the housing and a single second bearing surface at its opposite upper side facing the first main wall of the housing, and the first bearing surfaces have the intermediate area between them and the second bearing surface is located between the first bearing surfaces, and the first bearing surfaces are slidingly engaged with the second main wall of the housing and the second bearing surface is slidingly engaged with the first main wall of the housing to slide across it during movement of the eject arm from the first to the second position and the gap is present between the under side of the eject arm in the intermediate area and the second main wall of the housing.

3. A holder for cards comprising:

a housing having a first and second opposite, mutually spaced first and second main walls and configured to tightly fit around a stack of at least three, mutually registered, cards of equal dimension and a receiving space of which is designed such that the cards parallel to the first main wall must be slid into and out this receiving space;

internally of the housing a friction element which engages a thin edge of each individual card within the housing and provides a friction force to it, which friction element has sufficient dimension to simultaneously engage the thin edges of all cards of the stack, both when the cards are completely within the housing and when the cards partly project from the housing such that gravity force alone is unable to move the cards in and out of the housing;

a card opening at the housing to insert and remove cards in and out of the housing;

opposite the card opening within the housing a card eject feature having an actuator button projecting from the holder and configured such that the complete cards stack can be partly slid from the housing through the opening by actuating the button, which card eject feature has an eject arm with two opposite sides, an under side and an upper side and which with its mounting location is movably mounted to the housing and designed, by actuating the button, to move within the housing from a retracted position to an eject position and during said eject movement to engage the complete cards stack and to urge this complete cards stack to partly slide from the housing through the opening during which eject movement the shape of the cards stack, since the eject arm along its length is provided with a stepped relief profile on its upper side comprising a separate thin side edge for engaging each of the cards of the stack, changes from a straight shape with all cards mutually registered, into a staggered shape with all cards partly projecting from the housing through the opening, each card projecting further compared to the adjacent card above it in the stack such that each card is visible and wherein the friction element maintains the staggered shape of the partly from the housing projecting stack by engaging it;

wherein the eject arm with its under side is slidingly supported by the second main wall of the housing and with its upper side is slidingly supported by the first main wall;

wherein the eject arm has an intermediate area along its length and in this intermediate area its under side has a gap with this second main wall, while at both longitudinal ends of this intermediate area the eject arm at its under side has first bearing surfaces slidingly engaged with the second main wall to slide across it during movement of the eject arm from the retracted to the eject position, such that, due to the presence of the gap, the eject arm in the intermediate area is able to deflect towards the second main wall of the housing, at least partially closing the gap, while at both longitudinal ends of this intermediate area the eject arm is unable to deflect towards the second main wall when the intermediate area is deflecting toward the second main wall and the first bearing surfaces are bearing against the second main wall.

4. Holder according to claim 3, wherein the under side of the eject arm is recessed in the intermediate area to create the gap between the eject arm under side and the second main wall of the housing.

5. Holder according to claim 3, wherein the intermediate area and the stepped relief profile overlap and the eject arm is made flexible in the direction to and from the second main wall of the housing since a length part of the eject arm in the intermediate area is made thinner to allow the intermediate area to deflect towards the second main wall.

6. Holder according to claim 5, wherein the eject arm is made flexible in that, viewed from a tip of the eject arm in the direction of the location where the eject arm is mounted to the holder, the dimension of the eject arm in the direction to and from the second main wall of the holder, in other words the thickness of the eject arm, decreases beyond the stepped relief profile since the stepped relief profile ends in a second bearing surface slidingly engaged with the first main wall of the housing and beyond this second bearing surface the distance of the upper side of the eject arm to the facing, first main wall of the housing increases.

7. Holder according to claim 6, wherein at the second bearing surface the eject arm has a first thickness, measured in the direction to and from the second main wall of the holder, and a length part of the eject arm extending from the second bearing surface towards the location where the eject arm is mounted to the holder has a length of at least 12 millimeter and has a second thickness which is not more than half the first thickness.

8. Holder according to claim 6, wherein the flexibility is such that, relative to the direction of its thickness, in other words the direction to and from the second main wall of the holder, the tip of the eject arm deflects at least 3 millimeter if loaded by a weight of 1 kilogram while the mounting location of the eject arm is fixedly clamped in the way a cantilevered beam is fixedly clamped with one of its ends.

9. Holder according to claim 3, designed such that if the button is actuated the eject arm from the retracted position is moved to the eject position and slides the cards stack outward through the card opening wherein the first and second bearing surfaces contact and slide across the relevant first and second main walls of the housing and during this movement the cards stack loads the stepped relief profile by a force directed towards the second main wall causing the under side of the eject arm in the intermediate area to deflect towards the second main wall of the housing such that the gap between the under side of the eject arm and the facing second main wall of the housing is at least partially closed and the second bearing surface looses contact with the first main wall of the housing, while both the first bearing surfaces maintain contact with the second main wall of the housing.

10. Holder according to claim 3, the gap (8) measures at least 0.2 millimeter between the relevant part of the eject arm and the second main wall of the holder, such that the eject arm can move in and out said gap while deflecting.

11. A holder for cards, comprising a housing having a first and second opposite, mutually spaced first and second main walls which determine a maximum stack thickness, which housing internally has a friction element which engages a thin edge of each individual card within the housing and provides a friction force to it, which friction element has sufficient dimension to simultaneously engage the thin edges of all cards of the stack, both when the cards are completely within the housing and when the cards partly project from the housing such that gravity force alone is unable to move the cards in and out the housing; and which housing tightly fits around a stack of at least three cards and has at least one card opening for locating and removing cards, while opposite the card opening within the housing a card eject feature having an eject arm having two opposite sides, an under side and an upper side, is provided such that the cards through the card opening can be partly slid from the housing by the eject arm, which card eject feature is designed to move, by manual actuation, the eject arm within the housing between a first and a second position, which eject arm has at its upper side, in other words its side facing the first main wall, a stepped relief profile which engages the card stack during ejection and during said movement from the first to the second position the eject arm engages the cards and forces the cards to partly exit the housing wherein the holder has a feature to avoid jamming due to imperfect cards or imperfect flatness of the main walls of the card holder of the eject arm of the card eject feature while engaging the cards stack and forcing them to exit the housing, which feature comprises a gap that is present between the second main wall and the facing under side of the eject arm, allowing the eject arm to deflect into said gap and towards the second main wall to avoid jamming of the eject arm, which deflection is allowed at an intermediate area along the length of the eject arm, such that on both longitudinal ends of this area such deflection is absent, by providing that said gap is present at said intermediate area while said gap is absent at both longitudinal ends of this area of the eject arm, such that the eject arm is allowed, at the intermediate area, to deflect towards and away from the main walls of the housing.

12. Holder according to claim 11, wherein the intermediate area (8) at least partly overlaps with at least part of the stepped relief profile (19) at the upper side of the eject arm, for ejecting the cards stack in staggered fashion.

13. Holder according to claim 12, said intermediate area (8) partly overlaps with said stepped relief profile (19) and also extends some distance beyond said stepped relief profile towards a location where the eject arm is mounted (17) to the housing, for a distance of at least 5 millimeter.

14. Holder according to claim 12, said intermediate area (8) partly overlaps with said stepped relief profile (19) and also extends some distance beyond said stepped relief profile towards a location where the eject arm is mounted (17) to the housing, for a distance of at least 9 millimeter.

15. Holder according to claim 12, said intermediate area (8) partly overlaps with said stepped relief profile (19) and also extends some distance beyond said stepped relief profile towards a location where the eject arm is mounted (17) to the housing, for a distance of at least 12 millimeter.

16. Holder according to claim 11, the gap (8) measures at least 0.2 millimeter between the relevant part of the eject arm and the second main wall of the holder, such that the eject arm can move in and out said gap while deflecting.

17. Holder according to claim 11, wherein the eject arm has at its upper side a bearing face (21) intermediate a tip (5) and the mounting location (17) of the eject arm, which bearing face slidingly engages the first main wall (4).

18. Holder according to claim 17, wherein said bearing face (21) is located at a longitudinal distance from the tip (5) corresponding to a distance somewhere between one third and two third the length of the intermediate area.

19. Holder according to claim 11, wherein the eject arm has a flexibility such that a tip of the eject arm will deflect at least 1 millimeter towards one of the first and second housing main walls when loaded at the tip by a force of 1 kilogram directed towards said one of the first and second holder body main walls and the eject arm is fixedly clamped at its mounting point.

20. Holder according to claim 11, wherein the eject arm has two longitudinally spaced first bearing surfaces (7) at its side facing the second housing main wall and a single second bearing surface (21) at the first main wall (4).

21. Holder according to claim 20, wherein the first bearing surfaces (7) have the intermediate area between them.

22. Holder according to claim 20, wherein the second bearing surface (21) is located between the first bearing surfaces (7).

23. Holder according to claim 11, the gap (8) measures at least 0.35 millimeter between the relevant part of the eject arm and the second main wall of the holder, such that the eject arm can move in and out said gap while deflecting.

24. Holder according to claim 11, the gap (8) measures at least 0.5 millimeter between the relevant part of the eject arm and the second main wall of the holder, such that the eject arm can move in and out said gap while deflecting.

25. Holder according to claim 11, wherein in its second position, the eject arm extends diagonally within the card holder, while in its first position, the eject arm extends parallel to an external side or edge of the card holder opposite card opening (3) from which the cards are dispensed from within the card holder.

26. Holder according to claim 11, wherein the eject arm is provided with said relief profile (19) for engagement with the stack of cards to push the stack of cards out of the holder such that in the second position a staggered stack of cards is presented, partly projecting from the holder, while in the first position a neat stack of mutually registered cards is completely contained within the housing.

27. Holder according to claim 11, the cards are of credit card format wherein the main dimensions suffice ISO 7810 and the thickness and roundings suffice ISO 7813.

* * * * *